US008235310B2

(12) United States Patent
Birrenkott et al.

(10) Patent No.: US 8,235,310 B2
(45) Date of Patent: Aug. 7, 2012

(54) SPRAYING DEVICE WITH INTERCHANGEABLE CARTRIDGE

(75) Inventors: Brian Birrenkott, Dublin, OH (US); Paul Havlovitz, Dublin, OH (US); Steve Cichy, Marysville, OH (US); Michael Cavins, Marysville, OH (US); Jon Moyer, Columbus, OH (US)

(73) Assignee: OMS Investments, Inc., Los Angeles, CA (US)

( * ) Notice: Subject to any disclaimer, the term of this patent is extended or adjusted under 35 U.S.C. 154(b) by 0 days.

(21) Appl. No.: 12/797,415

(22) Filed: Jun. 9, 2010

(65) Prior Publication Data

US 2010/0243760 A1 Sep. 30, 2010

Related U.S. Application Data

(63) Continuation of application No. 11/368,963, filed on Mar. 6, 2006, now abandoned, which is a continuation of application No. 10/712,970, filed on Nov. 13, 2003, now Pat. No. 7,156,324.

(51) Int. Cl.
*B65D 1/32* (2006.01)

(52) U.S. Cl. ..... 239/327; 239/345; 239/369; 239/571; 239/581.1

(58) Field of Classification Search ..... 239/310, 239/315, 318, 323, 327, 328, 340, 345, 350, 239/354, 369, 375–377, 379, 394, 546, 526, 239/571, 581.1
See application file for complete search history.

(56) References Cited

U.S. PATENT DOCUMENTS

| | | | |
|---|---|---|---|
| 813,254 | A | 2/1906 | Sweeney |
| 1,777,925 | A | 10/1930 | Kollmann |
| 2,293,390 | A | 8/1942 | Hengesbach |
| 2,606,068 | A | 8/1952 | Bonacor |
| 2,961,335 | A | 11/1960 | Shepard |
| 2,991,939 | A | 7/1961 | Packard |
| 3,052,417 | A | 9/1962 | Daniel |
| 3,159,176 | A | 12/1964 | Russell et al. |
| 3,174,691 | A | 3/1965 | Haviland |
| 3,323,685 | A | 6/1967 | Schultz |

(Continued)

FOREIGN PATENT DOCUMENTS

WO WO 02/085533 10/2002

OTHER PUBLICATIONS

Supplementary European Search Report for European Patent Application 04 81 0535 mailed Sep. 3, 2009.

*Primary Examiner* — Christopher Kim
(74) *Attorney, Agent, or Firm* — Hunton & Williams LLP

(57) ABSTRACT

A spraying device is provided that includes a cartridge containing a first fluid, the cartridge being removably connected to a sprayer body. The cartridge is oriented such that gravity exerts a downward force on the first fluid. The sprayer body includes a conduit for receiving a second fluid. A valve is coupled to the conduit. The valve allows the second fluid to flow through the valve, thus creating a Venturi vacuum that draws the first fluid out of the cartridge and into the valve to enable the first and second fluids to mix and form an outlet stream. An orifice meters a predetermined amount of the first fluid into the valve to achieve a predetermined ratio of the first fluid to the second fluid. The outlet stream is then dispensed from a spray nozzle.

3 Claims, 9 Drawing Sheets

U.S. PATENT DOCUMENTS 3,612,404 A 10/1971 Vicari
3,628,732 A 12/1971 Vicari
3,797,741 A 3/1974 Spencer
4,346,844 A 8/1982 Harmony
4,491,254 A 1/1985 Viets et al.
4,527,740 A 7/1985 Gunzel, Jr. et al.
4,878,619 A 11/1989 Norman
4,901,923 A 2/1990 McRoskey et al.
4,969,603 A 11/1990 Norman
5,069,389 A 12/1991 Bitsakos
5,332,158 A 7/1994 Styne et al.
5,375,769 A 12/1994 Schultz
5,413,280 A 5/1995 Taylor
5,415,351 A 5/1995 Otto et al.
5,469,993 A 11/1995 Hauf et al.
5,484,106 A 1/1996 Gilmond
5,630,548 A 5/1997 Chih
5,727,736 A 3/1998 Tryon
5,881,955 A 3/1999 Styne
5,918,621 A 7/1999 Gilmore
6,170,706 B1 1/2001 Havlovitz
6,415,956 B1 7/2002 Havlovitz
6,435,426 B1 8/2002 Copp, Jr.
6,453,953 B1 9/2002 Adriansens et al.
6,546,949 B1 4/2003 Gilmore
6,578,776 B1 6/2003 Shanklin et al.
6,604,546 B1 8/2003 Gilmore
6,609,733 B2 8/2003 Gilmore
7,188,785 B2 3/2007 Joseph et al.
2002/0175223 A1 11/2002 Chih

SPRAYING DEVICE WITH INTERCHANGEABLE CARTRIDGE

The present application is a continuation of and claims priority to U.S. patent application Ser. No. 11/368,963, filed on Mar. 6, 2006, entitled "Spraying Device with Interchangeable Cartridge," which is a continuation of and claims priority to U.S. patent application Ser. No. 10/712,970, now U.S. Pat. No. 7,156,324, filed on Nov. 13, 2003 entitled "Spraying Device with Interchangeable Cartridge." The disclosure of these priority applications is incorporated herein by reference in their entirety.

FIELD OF THE INVENTION

The present invention relates to a spraying device and more particularly to a spraying device that includes a sprayer body, a cartridge containing a first fluid, the cartridge being oriented such that gravity exerts a downward force on the first fluid, and a valve for mixing a second fluid with the first fluid by creating a vacuum that draws the first fluid out of the cartridge, without the need for a dip tube, and into the valve thus enabling the first and second fluids to mix and be dispensed.

BACKGROUND OF THE INVENTION

There are many known spraying devices for dispensing chemicals for lawn and garden applications. Typical spraying devices include a sprayer body connected to a container filled with a fluid (e.g., a concentrated chemical) and connected to a water hose. The fluids are mixed and dispensed via a spray head. Typical sprayers include a dip tube that extends downwardly into the container. The dip tube provides a direct passageway between the fluid in the container and the sprayer body. The constant flow of water through the sprayer produces a vacuum that draws the fluid through the dip tube, mixes the fluid with the water and dispenses the mixture from the spray head. Typical sprayers also include sealed containers for storing the fluid to be dispensed. These containers can only be used with a spraying device, they can not be used to manually dispense the contained fluid.

Other known sprayers divert a portion of the water from a hose into a container connected to the sprayer body. The water mixes with the contents of the container, filling the container. The pressure of the mixture in the container forces the mixture out of the container, into the sprayer body, and out the spray head.

However, there are drawbacks to the known sprayers, including complex construction and the inability to manually select the amount of chemical mixed with water. Therefore, a need exists for a spraying device that is capable of mixing a predetermined or selected ratio of a first fluid with a second fluid without the need for a dip tube and without having to mix the fluids in the container.

It is desirable to provide an inexpensive cartridge that is interchangeable.

It is also desirable to provide a cartridge that is substantially simpler and more economical to produce.

It is desirable to provide a sprayer body that is durable and reusable multiple times.

It is also desirable to provide a cartridge that allows small amounts of fluid to be dispensed without the use of a sprayer.

It is desirable to provide a spraying device that allows a user to adjust the ratio of a first fluid that is mixed with a second fluid (e.g., water) via an adjustable metering selector.

It is also desirable to provide a spraying device that includes a metering orifice for mixing a predetermined amount of a first fluid with a second fluid.

SUMMARY OF THE INVENTION

The present invention overcomes the disadvantages of the prior art by providing a spraying device that includes a cartridge containing a first fluid, the cartridge being removably connected to a sprayer body. The cartridge is oriented such that gravity exerts a downward force on the first fluid. The sprayer body includes a conduit for receiving a second fluid. A valve is coupled to the conduit. The valve allows the second fluid to flow through the valve, thereby creating a Venturi vacuum that draws the first fluid out of the cartridge and into the valve to enable the first and second fluids to mix and form an outlet stream. An orifice meters a predetermined amount of the first fluid into the valve to achieve a predetermined ratio of the first fluid to the second fluid in the outlet stream. The outlet stream may then be dispensed from a spray nozzle.

BRIEF DESCRIPTION OF THE DRAWINGS

These and other features of the present invention will be more fully disclosed when taken in conjunction with the following Detailed Description of the Invention in which like numerals represent like elements and in which.

DETAILED DESCRIPTION OF THE INVENTION

Figure 1:
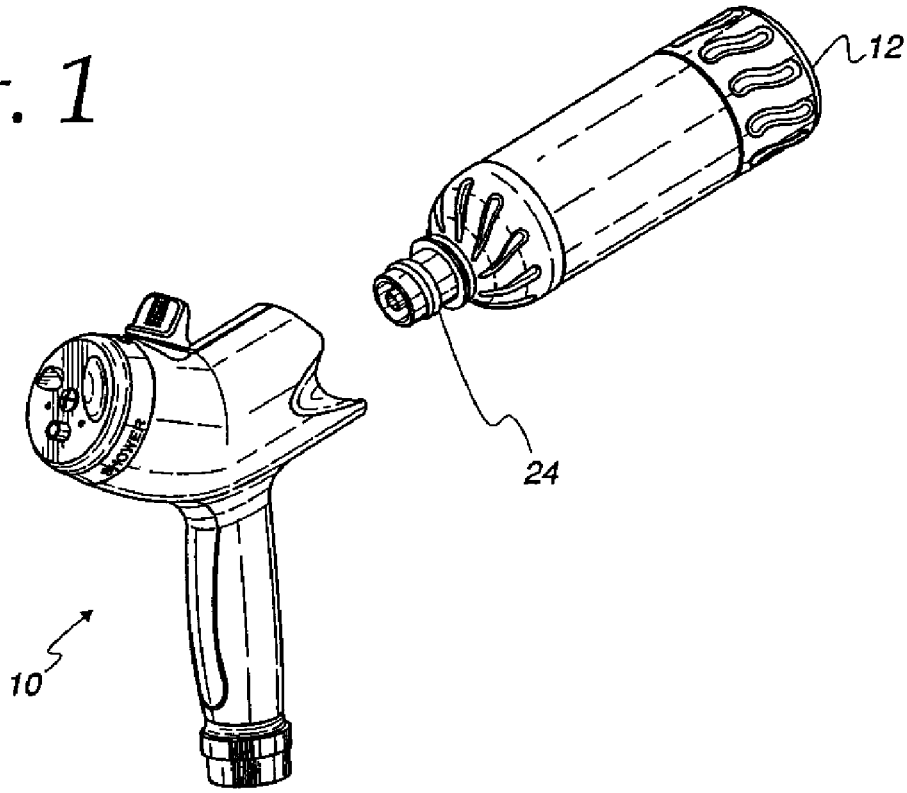
FIG. 1 shows a perspective view of one embodiment of a spraying device according to the present invention that includes a sprayer body and a cartridge.
Figure 2:
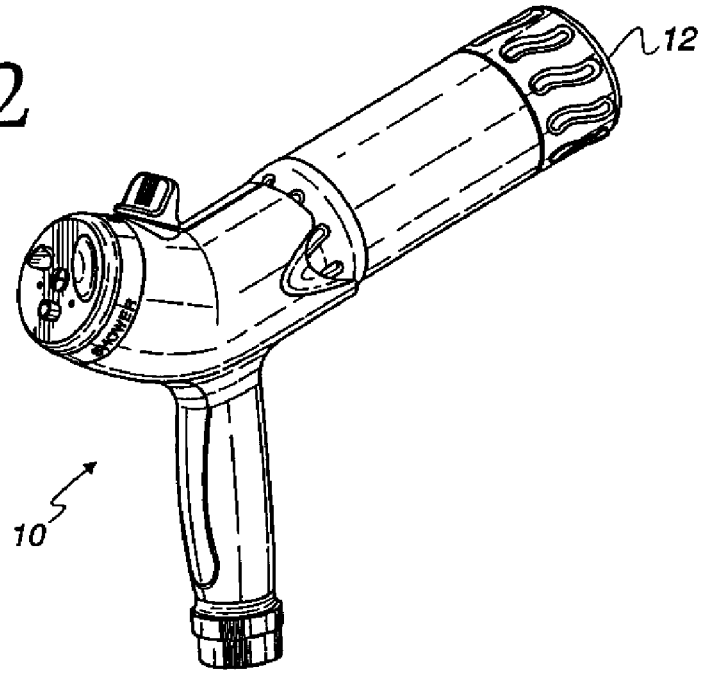
FIG. 2 shows a perspective view of an assembled spraying device according to the present invention.
Figure 3:
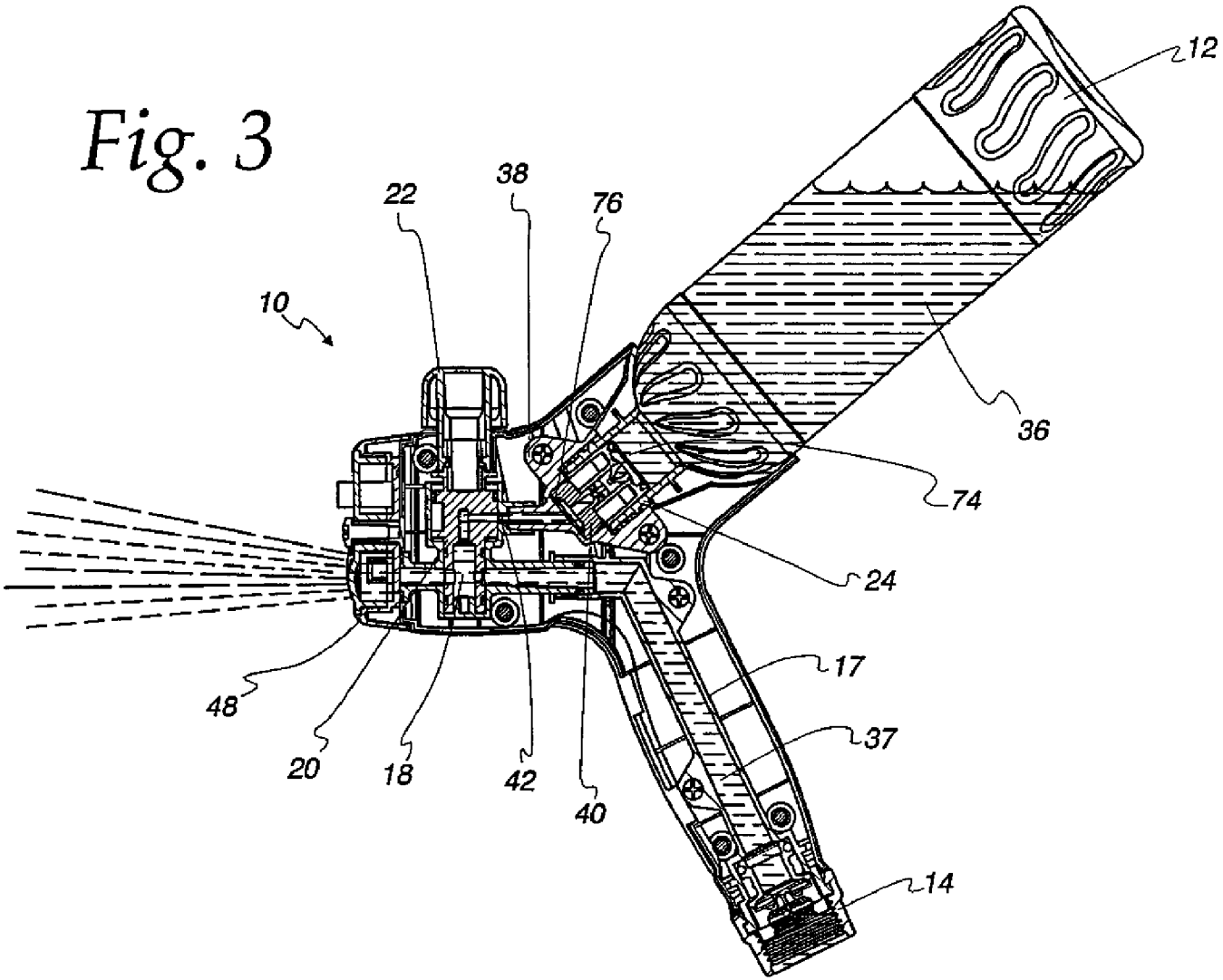
FIG. 3 shows a cross-sectional view of one embodiment of an assembled spraying device according to the present invention in the "feed" position.
Figure 12:
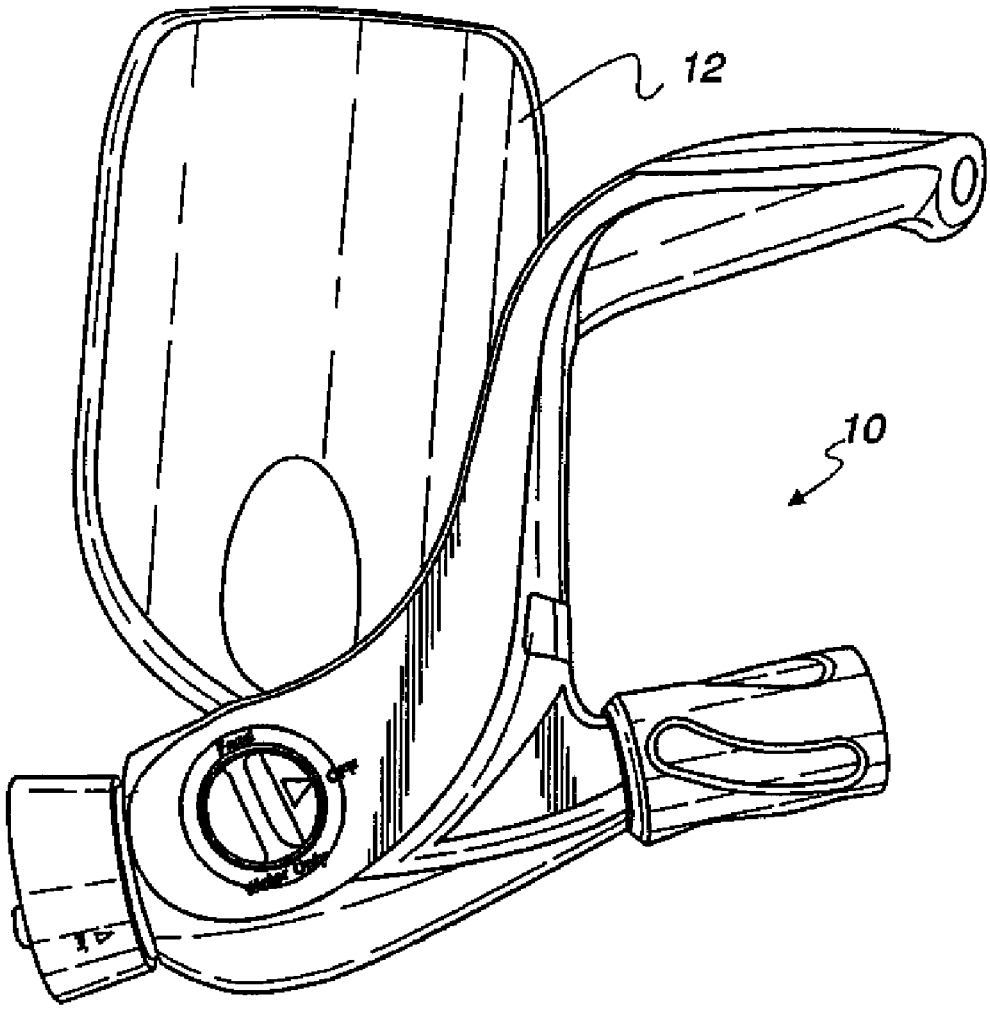
FIG. 12 shows a side view of another embodiment of a spraying device according to the present invention.

In one embodiment, a spraying device of the present invention generally includes two primary parts: a sprayer body 10 and a cartridge 12, as shown in FIGS. 1 and 2. The cartridge 12 is removably connected to the sprayer body 10 via threads 24, or other suitable connecting means, as shown in FIGS. 1-3. When the cartridge 12 is connected to the sprayer body 10, a first fluid 36 contained in the cartridge 12 flows into the sprayer body 10 and is mixed with a second fluid 37 (e.g., water) in valve 20, as explained below. The cartridge 12 can be made of flexible plastic, or any other suitable material. The cartridge 12 can have many different shapes and forms, including a flexible bottle, pouch or bag shape. An alternative cartridge design is illustrated in FIG. 12. The first fluid 36 may comprise liquid fertilizers, insecticides, herbicides, fungicides, mildewcides, nematicides, growth regulators, insect repellents, cleaning products, and the like.

Referring to FIG. 3, fluid conduit 17 is disposed in the sprayer body 10, which can be constructed from any suitable material, such as plastic. A first end of fluid conduit 17 is coupled to hose coupler 14. The sprayer body 10 connects to a typical home water supply (e.g., a garden hose) at coupler 14. In one embodiment, the coupler 14 includes an anti-siphon unit 16 (shown in FIG. 8), which is well known in the art, for preventing or minimizing back flow and leaking from fluid conduit 17. A second end of fluid conduit 17 is coupled to a valve 20, which is coupled to spray nozzle 48. As used herein, the terms "connected" and "coupled" both mean connected directly or indirectly through intervening components.

In one embodiment, the valve 20 includes a valve knob 22 for rotatably selecting between three conditions: off, feed and water only. The valve 20 is coupled to and actuated by the valve knob 22. The valve 20 further includes a Venturi location 18 for creating a vacuum for siphoning the first fluid from the cartridge 12. When the valve knob 22 is in the "feed" position, the second fluid 37 (e.g., water) flows into the valve 20 creating a Venturi vacuum that draws the first fluid 36 out of the cartridge 12.

Figure 8:
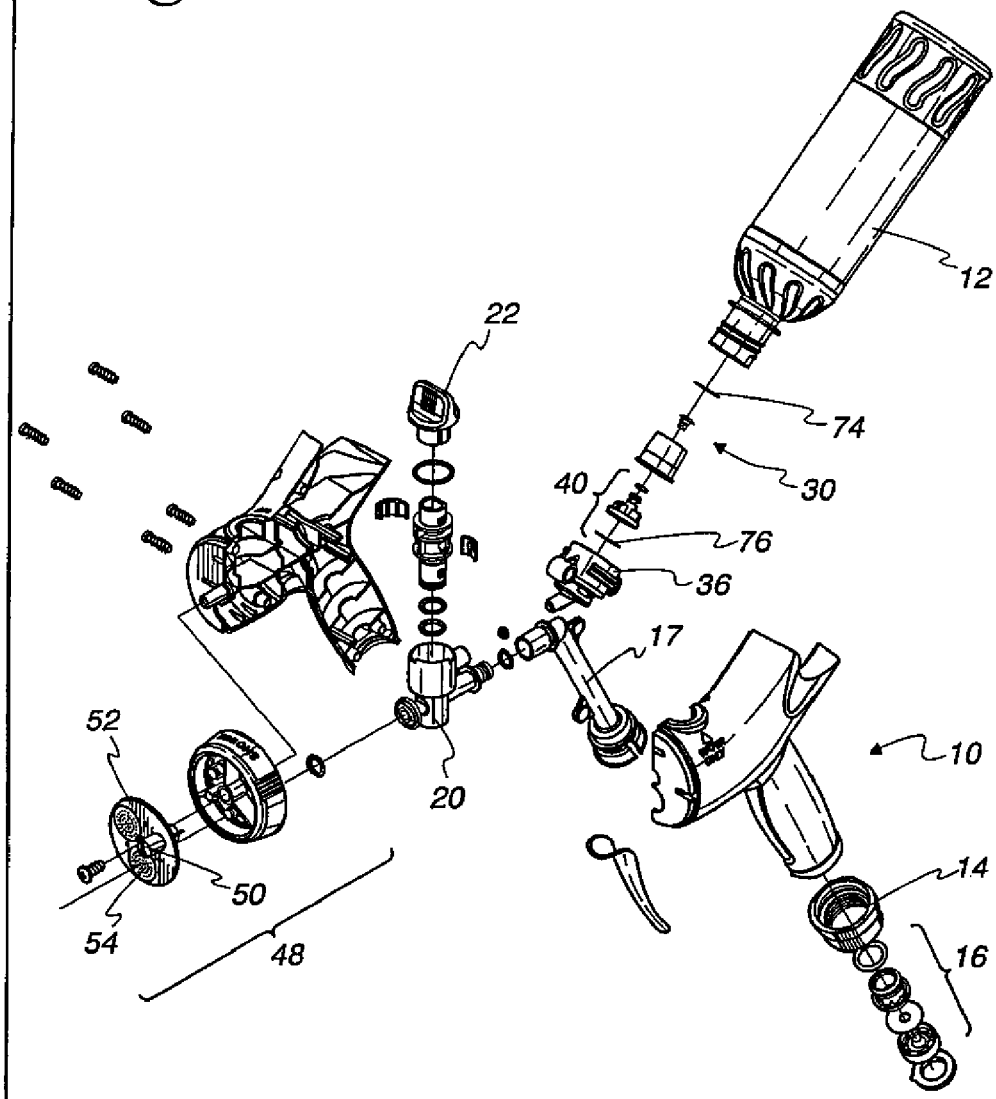
FIG. 8 shows an exploded view of one embodiment of a spraying device according to the present invention.

Specifically, the flow of the second fluid 37 through the valve 20 creates a vacuum therein. Because the cartridge 12 is oriented such that gravity exerts a downward force on the first fluid 36, the valve 20 is able to draw the first fluid 36 out of the cartridge 12 without the need for a dip tube. The first fluid 36 travels through cartridge adapter 38 and filter assembly 40. In one embodiment, the valve 20 includes a metering orifice 42 through which the first fluid flows into the valve 20 where it is mixed with the second fluid 37 at Venturi location 18. The mixture is then dispensed out of the spray nozzle 48. In one embodiment, the spray nozzle 48 is rotatably adjustable to provide different spray patterns via three different nozzle orifices: flat 50, jet 52 and shower 54, as shown in FIG. 8.

Figure 4:
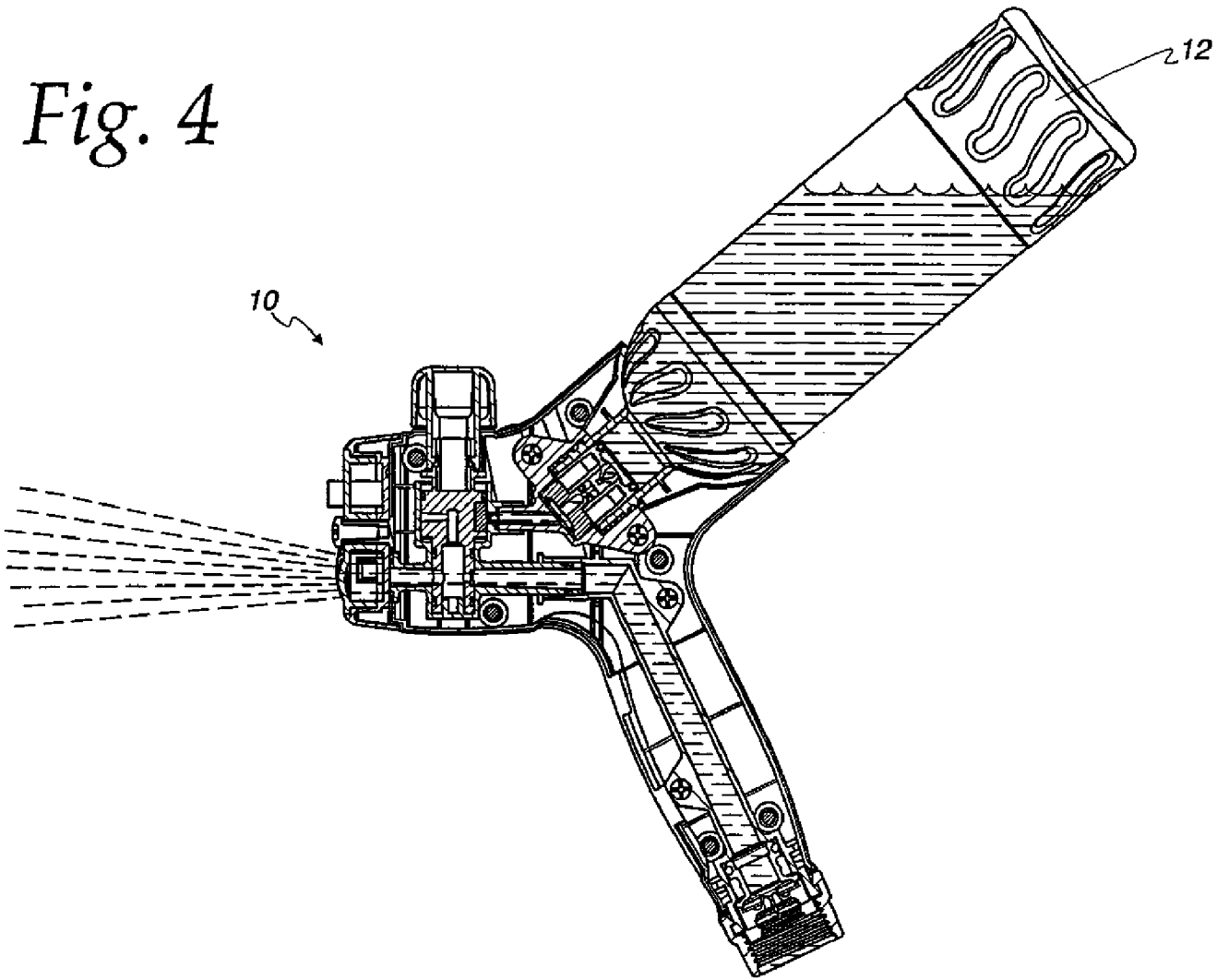
FIG. 4 shows a cross-sectional view of one embodiment of an assembled spraying device according to the present invention in the "water only" position.
Figure 5:
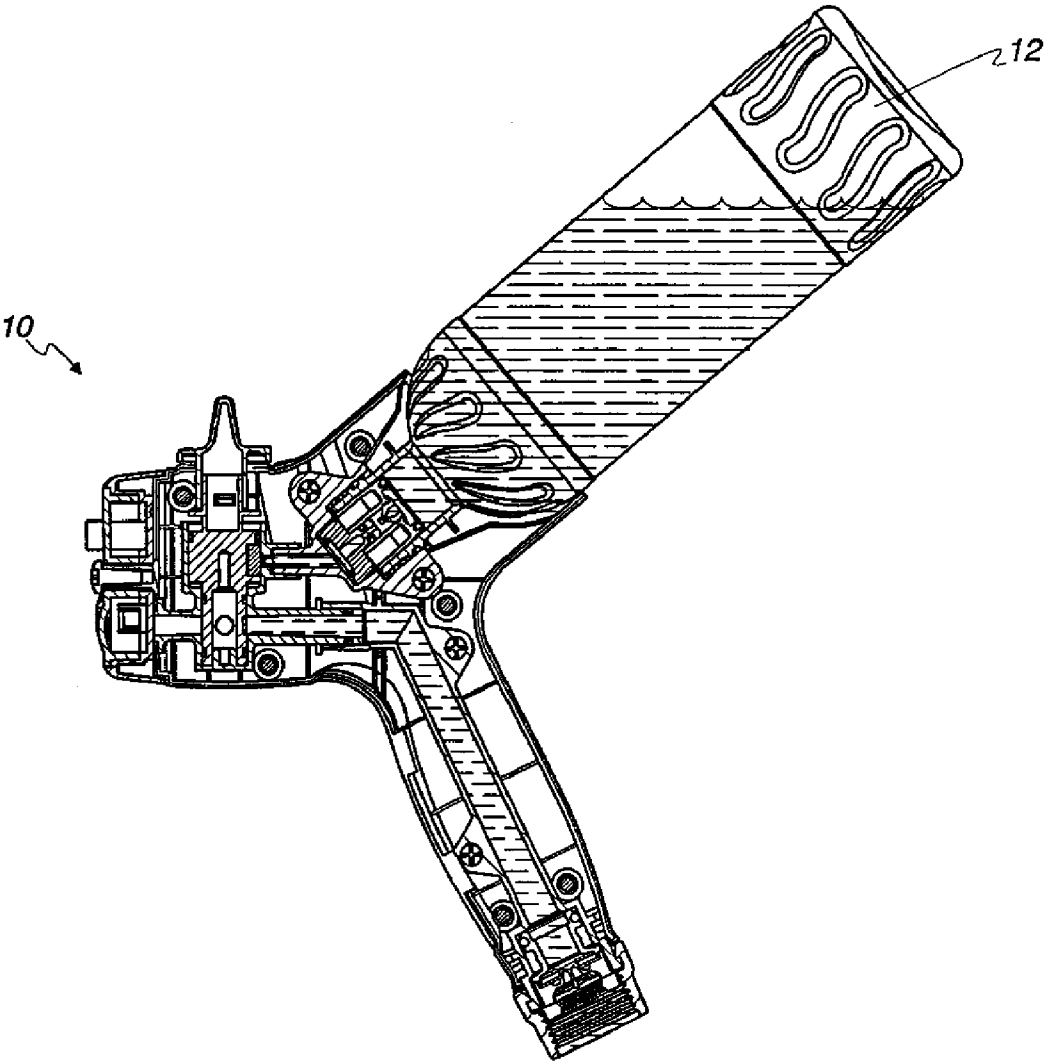
FIG. 5 shows a cross-sectional view of one embodiment of an assembled spraying device according to the present invention in the "off" position.

FIG. 3 shows the spraying device in the "feed" position, which mixes the two fluids and dispenses the mixture. FIG. 4 shows the spraying device in the "water only" position, which dispenses the second fluid 37 only. FIG. 5 shows the spraying device in the "off" position, which prevents either fluid from being dispensed.

Figure 6:
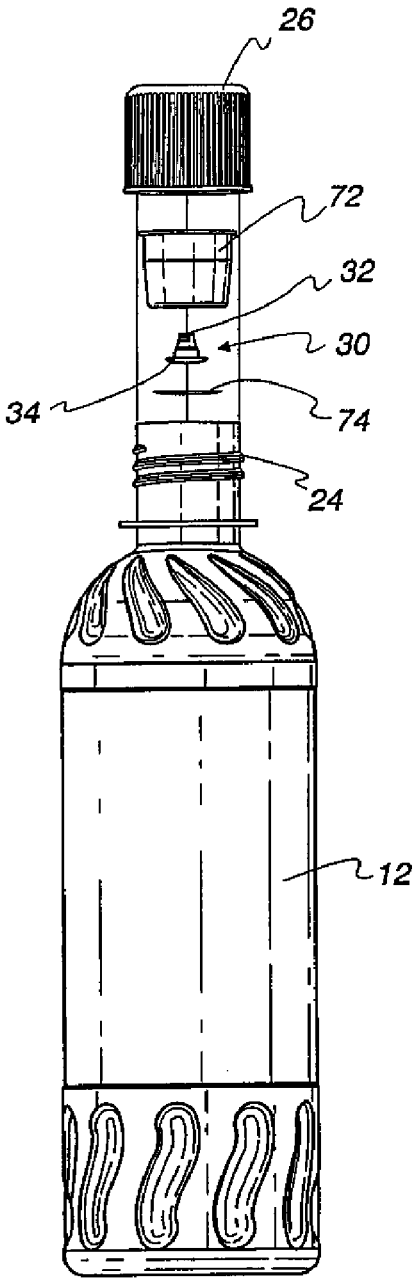
FIG. 6 shows an exploded view of one embodiment of a cartridge according to the present invention.
Figure 7:
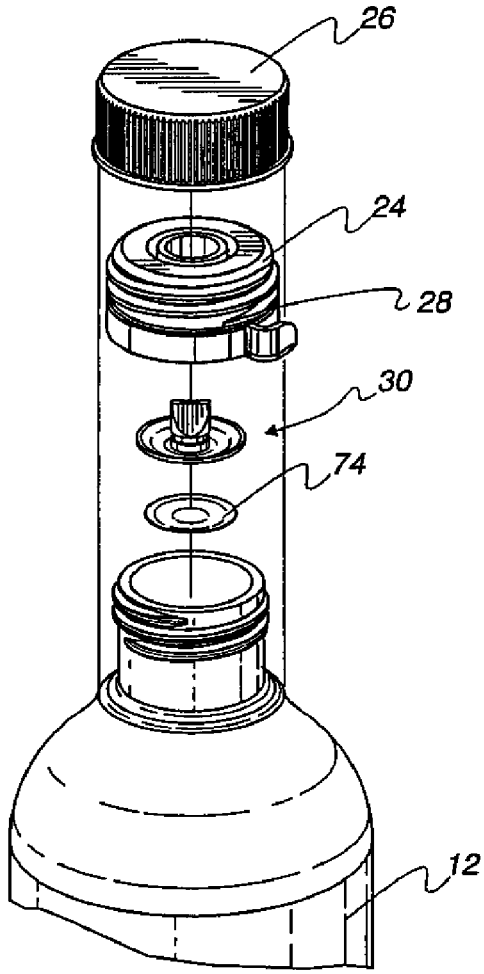
FIG. 7 shows a partial exploded view of another embodiment of a cartridge according to the present invention.

Referring to FIGS. 6 and 7, the cartridge 12 includes a two-way check valve 30 that keeps the cartridge sealed until the vacuum generated by the sprayer body 10 actuates the "duckbill" portion 32, which allows the first fluid 36 to be siphoned from the cartridge 12. Air is allowed back into the cartridge 12 via the "umbrella" portion 34 thus allowing proper venting and consistent mixing of the first fluid 36 with the second fluid 37 in the valve 20. The second fluid 37 does not enter the cartridge 12 during this process.

The check valve 30 allows the cartridge 12 to be removed from the sprayer body 10 at any time without leakage because the check valve 30 will return to a closed position when no vacuum is present. Another advantage of the cartridge 12 is that the first fluid can be manually dispensed from the cartridge 12 by squeezing the flexible cartridge 12 when it is in an inverted position. This allows a user to manually mix small quantities of the first fluid with a second fluid (e.g., water) in a bucket or watering can without the use of the sprayer body 10. This allows the first fluid to be distributed in small areas without the need for a garden hose. Previously known cartridges are sealed containers that can only be used with a corresponding spraying device.

In one embodiment, the cartridge 12 includes a cap 26 having threads that correspond to the threads 24 on the cartridge 12, as shown in FIG. 6. The cartridge 12 can be a sealed, non-refillable container, as shown in FIG. 6 or a refillable container that includes a secondary threaded closure 28, as shown in FIG. 7.

Figure 9:
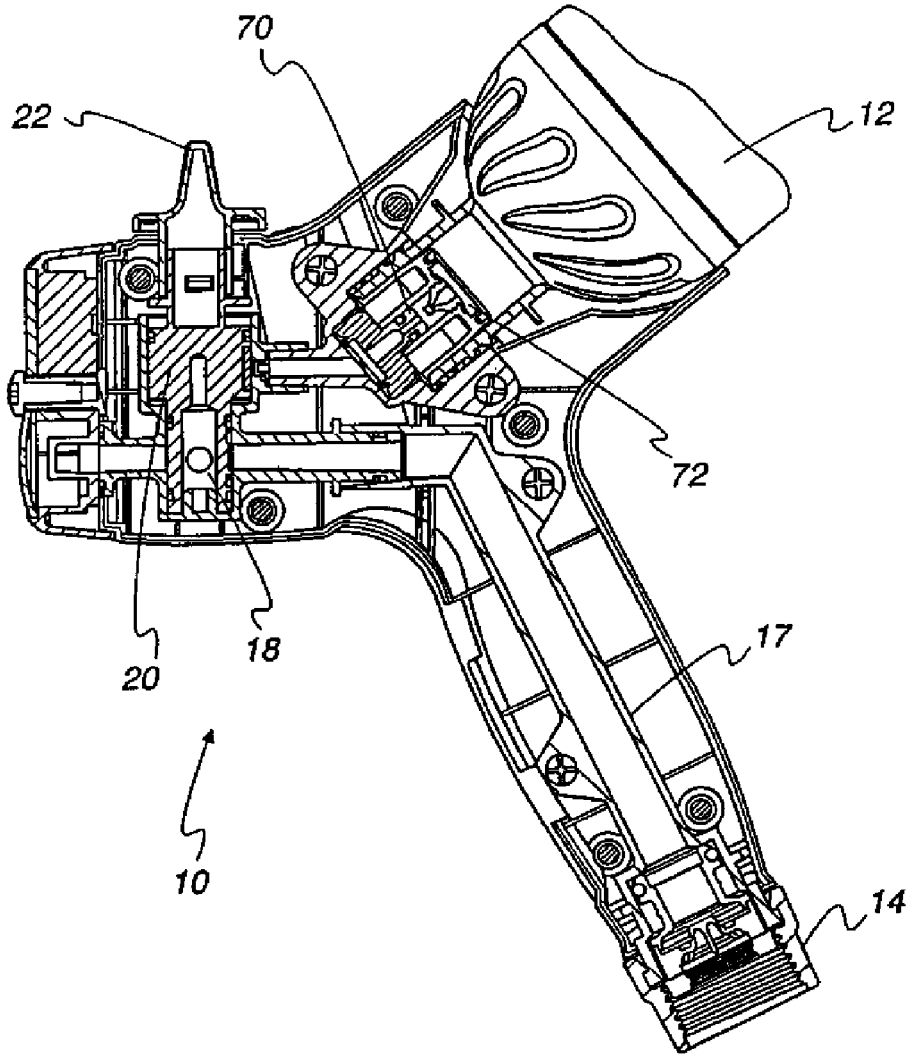
FIG. 9 shows a partial cross-sectional view of one embodiment of an assembled spraying device according to the present invention.

In one embodiment, fixed fluid metering is accomplished by including a metering orifice 70 within cartridge insert 72, as shown in FIG. 9. This allows mix ratio customization based on the particular fluid 36 contained within the cartridge 12. In another embodiment, the metering orifice 70 is included in the secondary threaded closure 28, as shown in FIG. 7. In both embodiments, cartridges containing different types of fluids can each have appropriately sized orifices to mix the proper ratio of the first fluid 36 with the second fluid 37. Providing the metering orifice within the cartridge 12 eliminates having to make or use different sprayers for different types of fluids.

Figure 10:
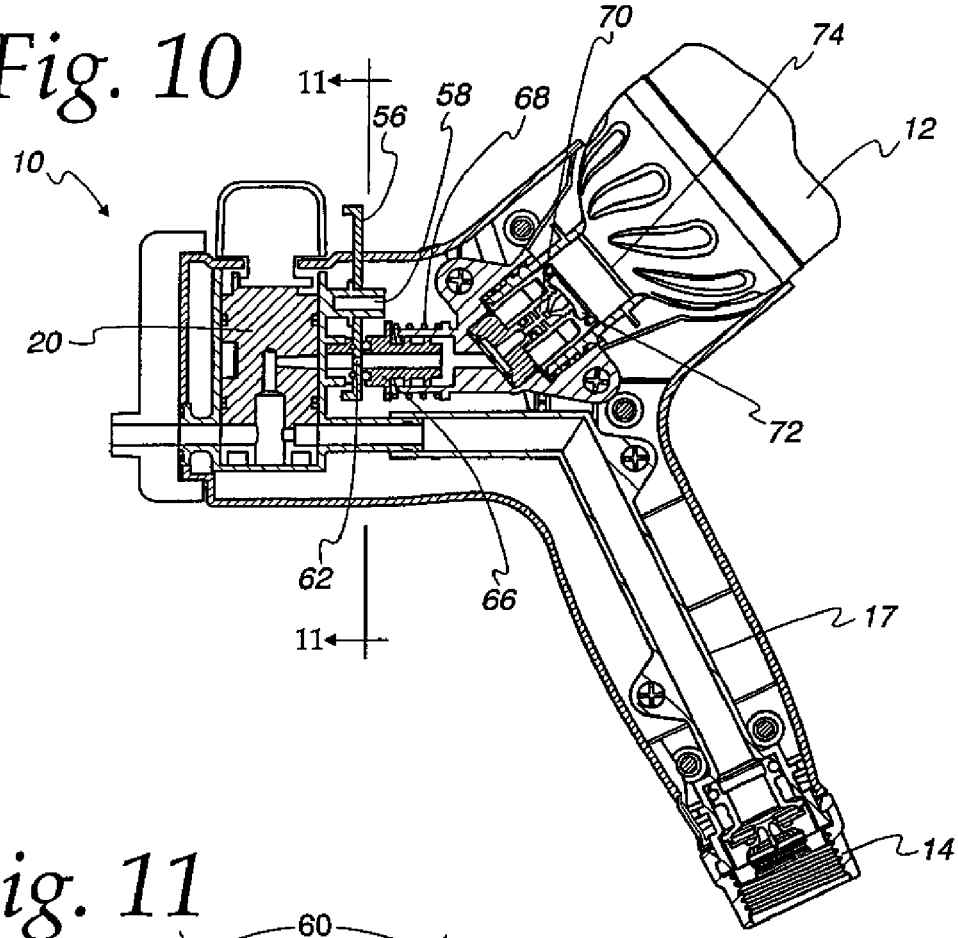
FIG. 10 shows a partial cross-sectional view of another embodiment of a sprayer body according to the present invention including an adjustable metering disc.
Figure 11:
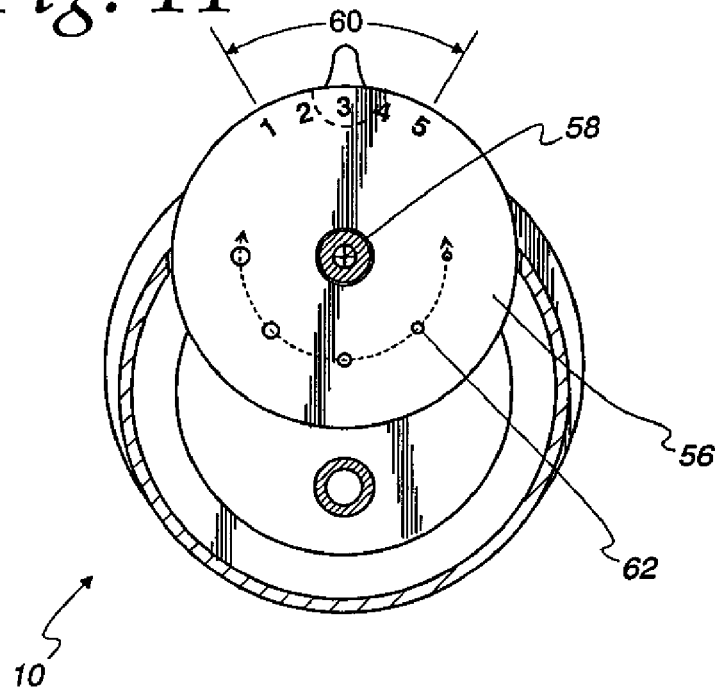
FIG. 11 shows a cross-sectional view of one embodiment of a sprayer body according to the present invention including an adjustable metering disc.

Variable fluid metering is accomplished by using an adjustable metering disc 56, as shown in FIGS. 10 and 11. The metering disc 56 rotates about axis 58. The disc 56 is manually rotated via a selector 60 that allows selection of one of several orifice sizes 62. The metering disc 56 is engaged against the valve 20 and a continuous seal is maintained by a floating plunger 66 that is kept against the metering disc 56 by a compression spring 68.

FIG. 10 shows a spraying device that includes both a fixed metering orifice 70 within the cartridge insert 72 and a variable metering disc 56 within the sprayer body 10. Any of the described fluid metering embodiments can be used independently or in conjunction with each other. The metering orifice determines the amount of the first fluid that is mixed with the second fluid so that a predetermined ratio of the first fluid to the second fluid can be dispensed in the outlet stream.

As shown in FIGS. 3, 6, 7, 8 and 10, fluid filters 74 and/or 76 may be included to assure that metering orifices 42 and/or 70 are kept open and functional.

An alternative embodiment of the spraying device is shown in FIG. 12. This embodiment includes a sprayer body 10 and cartridge 12 having different designs than the embodiment of FIGS. 1-2. However, the internal operation of this embodiment is generally the same as described above.

While particular embodiments of the invention have been shown and described in detail, it will be obvious to those skilled in the art that changes and modifications of the present invention, in its various embodiments, may be made without departing from the spirit and scope of the invention. Other elements, steps, methods and techniques that are insubstantially different from those described herein are also within the scope of the invention. Thus, the scope of the invention should not be limited by the particular embodiments described herein but should be defined by the appended claims and equivalents thereof.

The invention claimed is:

1. A spraying device cartridge comprising:

a first liquid contained within the spraying device cartridge;

a first end having a first diameter, configured to be removeably connected to a sprayer body, a second end having a second diameter and located opposite the first end wherein the second end is located in a position above the first end when the spraying device cartridge is connected to the sprayer body such that gravity exerts a downward force on the first liquid to pull the first liquid towards the first end;

the first end comprising:

a bore extending axially from the first end and having a diameter less than the first diameter and comprising a first set of external threads, the bore defining a fluid flow path for the first liquid, wherein a downstream direction is towards the first end and an upstream direction is towards the second end;

a secondary threaded closure being internally threaded for mounting over the first set of threads and being externally threaded for engagement with corresponding threads on the sprayer body or with corresponding threads on a closure cap, the secondary threaded closure having an aperture extending axially through a center bore that is coincident with the bore of the first end;

a check valve comprising a duckbill portion and an umbrella portion mounted in the bore and extending through the aperture, the duckbill portion comprising a path for the first liquid to flow through from the spraying device cartridge and the umbrella portion comprising an air flow path for venting of the spraying device cartridge;

a metering orifice disposed in the bore, within the secondary threaded closure and located in the fluid flow path downstream of to the check valve;

a fluid filter disposed within the bore in the fluid flow path upstream of the metering orifice such that the fluid filter serves to filter the first liquid prior to the first liquid flowing through the metering orifice.

2. A spraying device, comprising the spraying device cartridge of claim 1, and further comprising a sprayer body comprising:

a first conduit for receiving the first liquid from the spraying device cartridge when the spraying device cartridge is coupled to the sprayer body;

a second conduit for receiving a second liquid from an external source;

a valve structure, comprising a first liquid passageway and a second liquid passageway, configured such that the passage of the second liquid through the valve structure creates a reduced pressure that draws the first liquid out of the spraying device cartridge and into the valve structure without the need for a dip tube;

the first liquid passageway communicating with the first liquid from the first conduit and the second liquid passageway communicating with the second liquid from the second conduit, a manual actuator positioned in operative relationship with the valve structure enabling movement of the valve structure between three discrete positions comprising:

a) a first position enabling the second liquid to flow through the valve structure to create a reduced pressure in the valve structure which draws the first liquid out of the spraying device cartridge and into the valve structure wherein the first and the second liquids mix to form an outlet stream which flows through the valve structure;

b) a second position enabling only the second liquid to flow through the valve structure and blocking the flow of the first liquid through the valve structure, and c) a third position blocking the first and the second liquidfrom flowing through the valve structure; and an orifice for metering a predetermined amount of the first liquid from the spraying device cartridge into the valve structure in the first position to achieve a predetermined ratio of the first liquid to the second liquid in the outlet stream; and a spray nozzle configured to discharge the outlet stream.

3. The spraying device cartridge of claim 1, wherein the first liquid is capable of being dispensed from the spraying device cartridge by squeezing the spraying device cartridge in an inverted position when not connected to the sprayer body.

* * * * *